United States Patent [19]

Grabner et al.

[11] Patent Number: 5,048,393

[45] Date of Patent: Sep. 17, 1991

[54] REMOVAL TOOL FOR PROPELLING CHARGE MODULES

[75] Inventors: Dieter Grabner, Willich; Hans-Jürgen Engels, Mülheim, both of Fed. Rep. of Germany

[73] Assignee: Rheinmetall GmbH, Düsseldorf, Fed. Rep. of Germany

[21] Appl. No.: 589,021

[22] Filed: Sep. 27, 1990

[30] Foreign Application Priority Data

Sep. 27, 1989 [DE] Fed. Rep. of Germany ..... 3932131

[51] Int. Cl.[5] ..... F41A 9/24

[52] U.S. Cl. ..... 89/45; 89/34; 24/453

[58] Field of Search ..... 89/45, 46, 47, 30, 31, 89/34; 24/453, 606, 607

[56] References Cited

U.S. PATENT DOCUMENTS

| | | | |
|---|---|---|---|
| 880,688 | 4/1888 | Murray | 89/46 |
| 2,395,354 | 2/1946 | Temple | 89/31 |
| 2,876,931 | 3/1959 | Marsh | 227/9 |
| 3,170,362 | 2/1965 | Mewse | 24/453 |
| 3,534,650 | 10/1970 | Kobokawa | 24/453 |
| 3,855,899 | 12/1974 | Billottet et al. | 89/47 |
| 4,674,396 | 6/1987 | Pongratz et al. | 89/47 |
| 4,706,544 | 11/1987 | Zielinski et al. | 89/46 |

FOREIGN PATENT DOCUMENTS 18827 1/1905 Austria .

1703065 3/1972 Fed. Rep. of Germany .

*Primary Examiner*—Deborah L. Kyle
*Assistant Examiner*—Stephen Johnson
*Attorney, Agent, or Firm*—Spencer & Frank

[57] ABSTRACT

A removal tool for propelling charge modules stored in a charge magazine one behind the other and having a hollow ignition channel, which tool facilitates both the rapid manual removal of the charge modules from the magazine, and the loading of the charge modules, in desired portions to the charge chamber of a gun barrel to maintain emergency operations. The removal tool includes a holding rod for insertion into the hollow ignition channel of a desired number of the charge modules, a depth abutment disposed on the holding rod and axially adjustable to different propelling charge set lengths, and a clamping device which is activated by an actuating handle. When the actuating handle is operated, leaf springs disposed on the holding rod are spread open by an actuating plunger disposed within the holding rod. The leaf springs thus rest against the hollow ignition channel of the last loaded or picked-up charge module so that all of the charge modules picked up by and disposed on the holding rod are clamped together against a radial abutment face of the depth abutment. Thus, it is possible to quickly and easily take sets of propelling charge modulus of different lengths manually from a propelling charge magazine and supply same to the charge chamber of a gun.

12 Claims, 1 Drawing Sheet

REMOVAL TOOL FOR PROPELLING CHARGE MODULES

CROSS REFERENCE TO RELATED APPLICATION

This application claims the priority of Application Ser. No. P 39 32 131.2, filed on Sept. 27th, 1989 in the Federal Republic of Germany.

BACKGROUND OF THE INVENTION

1. Field of the Invention

The present invention relates to a tool for facilitating the manual removal and loading of charge packs or modules having a hollow or free ignition channel and stored in a magazine one behind the other.

2. Background Information

The storage of charge packs or modules having a hollow or free ignition channel, typically used for propelling an independent projectile shot by large-bore cannons, is disclosed, for example in Federal Republic of Germany published patent application DE 3,437,588 Al corresponding to U.S. Pat. No. 4,706,544. According to this reference, the charge modules are removed from a magazine and subsequently loaded into the charge chamber at the rear of the gun barrel automatically by a controllable transfer arm and a loading tray. However, if there is a malfunction in the power supply, emergency operation of the cannon must be performed manually, taking care that the charge modules stored in rows in the magazine are removed quickly by hand and supplied to the chamber of the gun barrel in the intended propelling charge length.

SUMMARY OF THE INVENTION

It is an object of the present invention to provide a removal tool which permits quick manual removal of a desired plurality of charge modules provided with a hollow ignition channel from a magazine in which the modules are one behind the other, and manual loading of the removed charge modules into a weapon.

The above object is generally achieved according to the present invention by a tool for manual removal of propelling charge modules of the type having a hollow ignition channel from a magazine in which the modules are stored one behind the other with the channels aligned, which tool comprises: a holding rod of a length and diameter permitting insertion of the holding rod into the hollow ignition channel of a desired number of charge modules; a radially oriented depth abutment mounted on the holding rod for axial displaceable along the holding rod; means for fastening the abutment at a desired location along the holding rod; and a manually actuated clamping means, mounted in the holding rod, for axially arresting charge modules which are disposed around the holding rod relative to the depth abutment.

In an advantageous manner, the present invention allows simple emergency manual operation. That is, by means of the removal tool according to the invention, propelling charge modules stored one behind the other in a propelling charge magazine and provided with a hollow ignition channel can be manually removed in required propelling charge set portions. The empty space of the charge module ignition channel is advantageously utilized for the manual removal. A removal tool holding rod is inserted into the empty or free space of the hollow ignition channel of the propelling charge modules to load the charge packs which are stored serially, i.e., one behind the other, in a magazine. Another advantage lies in the provision for axial displacement of a depth abutment on the holding rod to permit simple apportioning of the number of loaded charge modules of predetermined propelling charge lengths for the required charge module set.

In order for charge modules held on the holding rod to be removed from the magazine, the simple actuation of a handle for a plunger of a clamping device, mounted in the holding rod at an outer end of the holding rod, arrests the loaded charge modules axially relative to the depth abutment. This insures that operating personnel can safely move the charge modules on the holding rod and load them into the charge chamber of a gun. The clamping device exerts a clamping force on the exterior of the last picked-up or engaged charge module in the direction of the depth abutment so that all picked-up propelling charge modules are held safely.

Because the externally and manually operated actuating plunger of the clamping device is mounted to the holding rod, the clamping device is substantially protected against external and extraneous influences in a space saving manner.

According to a further feature, the clamping device includes several leaf springs disposed on the holding rod. The outer ends of these leaf springs can be easily spread open by the actuating plunger so that they clamp to the exterior of the last picked-up or loaded charge module to facilitate removal. Cams disposed on the interior of the respective leaf springs spread the springs open upon axial operation of the actuating plunger, which is provided with a rounded end cap of a larger diameter than the remainder of the plunger, so that the springs rest gently against an existing external transition radius of the hollow ignition channel of the last loaded charge module to be removed. These cams may be, for example, hemispherically shaped.

The return of the actuation plunger into its starting position occurs automatically by means of a compression spring so that, at the end of the clamping process, the leaf springs are able to spring back into recesses provided on the holding rod.

The required number of charge modules to be loaded can be set by displacing the depth abutment, and markers on the holding rod are used to indicate the correct length of a propelling charge set, i.e., the number of charge modules. The depth abutment can be fixed in a form locking manner within grooves disposed on the surface of the holding rod.

The removal tool is primarily composed of easily manufactured, rotationally symmetrical components, which can be installed in an uncomplicated manner by means of screw connections.

The invention will now be described below in greater detail with reference to a embodiment thereof that is illustrated in the drawing figures.

DETAILED DESCRIPTION OF THE PREFERRED EMBODIMENT(S)

Figure 1:
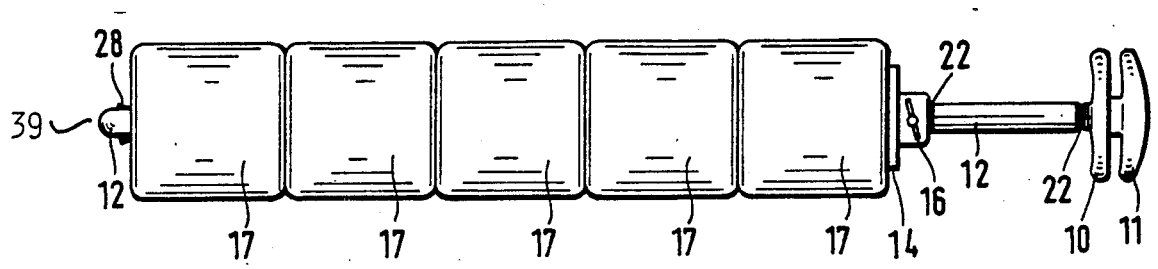
FIG. 1 is a side view of the removal tool according to the invention with a number, i.e., five, of loaded or picked-up propelling charge modules.
Figure 2:
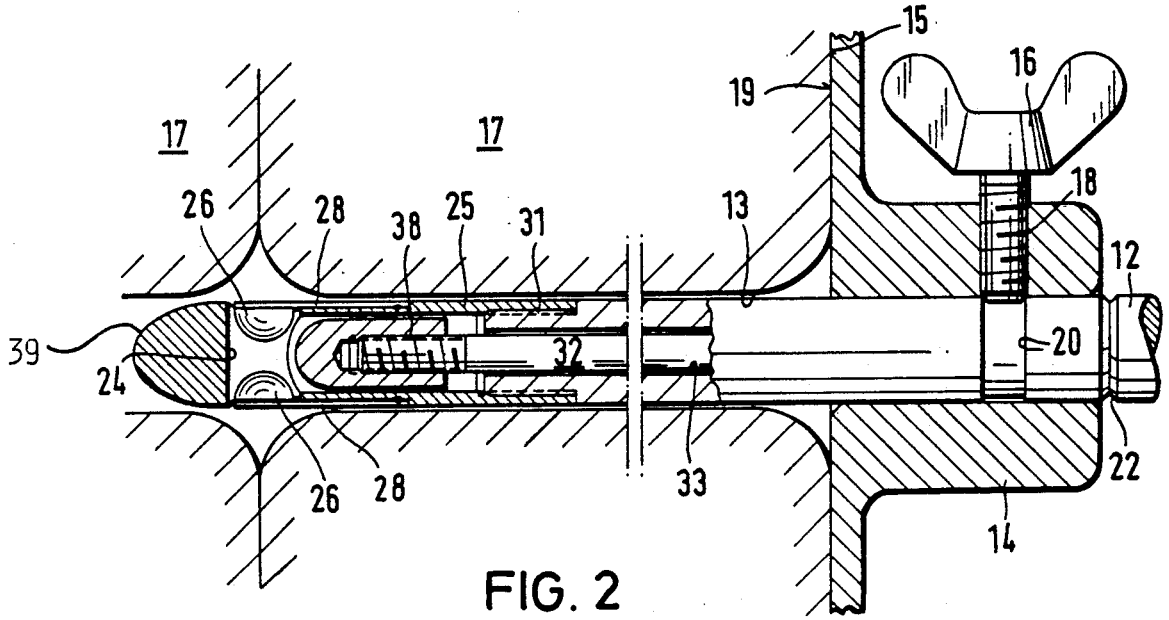
FIG. 2 is an enlarged sectional view of a portion of the removal tool of FIG. 1 during the insertion into the ignition channel of the propelling charge module.

FIG. 1 shows the removal tool with a plurality of, for example, five, propelling charge modules 17 that have been picked up from a propelling charge magazine (not shown), with the charge modules 17 arranged one behind the other and each having a hollow ignition channel 13 (FIG. 2). The removal tool is composed of a holding rod 12 which can be pushed through the aligned hollow ignition channels 13 of a desired number of modules 17, a depth abutment 14 arranged on the holding rod 12 so as to be axially displaceable thereon, a holding handle 10 fixed to the holding rod 12, and a clamping device composed of an actuating handle 11, an actuating plunger 32, a cap 34 for the plunger 32, and leaf springs 28 equipped with internal cams 26. The clamping device is shown in greater detail in FIGS. 2 and 3.

Before a charge module 17 is picked up by the tool, depth abutment 14 on holding rod 12 is set via a fastening screw 16 to a certain desired propelling charge length, in order to determine the number of charge modules 17 to be picked up or loaded. To set the position of the depth abutment 14, the fastening screw 16, which is axially held in a form locking manner by a radially arranged thread 18 in the depth abutment 14, is engaged in one of several circular grooves 20 provided on the exterior surface of the holding rod 12. In order for the axial adjustment position of depth abutment 14 to be easily determined by a user, several additional markers 22, for example in the form of grooves, are also provided on the exterior or circumferential surface of the holding rod 12 with the distance between adjacent marking grooves 22 corresponding to the length of a charge module 17. Moreover, with locating groove 20 as shown, the spacing between each groove 20 and an associated marking groove 22 is such that the screw 16 will be aligned with the groove 20 when the associated marking groove 20 is adjacent the outer end surface of the depth adjustment 14.

The clamping device composed of the actuating handle 11, the actuating plunger 32, the cap 34 and the leaf springs 28 preferably provided with internal cams 26, is actuated by manually pressing the actuating handle 11 against the holding handle 10. This causes the actuating plunger 32 to be axially displaced within the holding rod 12. This axial displacement results in the cap 34 of the plunger 32 contacting the preferably semicircular cams 26, which are disposed on the interior of leaf springs 28 and which, in a manner not shown, may have a sloped contact surface, and causing the cams 26 and springs 28 to be spread apart to such an extent that the picked-up charge modules 17 are axially arrested relative to the depth abutment 14. The end surface 15 of the first charge module 17 lies against a radially extending abutment surface 19 of the depth abutment 14 (see FIG. 2), while the last picked up charge module 17 is held by leaf springs 28 pressed against the exterior rounded portion of the hollow ignition channel 13 (see FIG. 3).

The actuating plunger 32 of the clamping device is disposed in a longitudinal bore 33 of the holding rod 12 and is firmly connected at its end which projects from holding handle 10 to the actuating handle 11 via a fastening means 46 in the form of a securing pin. At its other end, i.e., the end opposite the actuating handle 11, the actuating plunger 32 includes the cap 34 which has a diameter larger than the actuating plunger 32 and bore 33, which is rounded at its front end, and which is connected by way of a releasable threaded connection 38 with the actuating plunger 32. At least two oppositely disposed cams 26 project into the axial displacement region of the rounded cap 34 and are each disposed at the interior front end of an associated leaf spring 28 which extend longitudinally and substantially parallel to the longitudinal axis of the tool. Each one of the pair of leaf springs 28 arranged opposite one another on the holding rod 12 is connected at its rear end 35 with the holding rod 12. When not actuated or spread, the two oppositely disposed preferably hemispherical cams 26 project into a common transverse bore 24 in the holding rod 12.

The holding rod 12 preferably is composed of two assemblable components, including a front rod attachment 25 for receiving the leaf springs 28 which is releasably connected with the rear rod portion of holding rod 1 by means of a thread 31 disposed in an axial bore 36. Rod attachment 25 and the front end of holding rod 12 are configured such that the outer contours of leaf springs 28 and of rod attachment 25 have the same outer diameter as holding rod 12. Each one of the (preferably four) leaf springs 28 fits into a respective recess 30 of rod attachment 25, with which the springs 28 are connected at the rear ends 35 of recesses 30. Since rod attachment 25 additionally has an ogival shape at its front end 39, it is possible to gently insert the holding rod 12 into the hollow ignition channels 13 of the charge modules 17.

Figure 3:
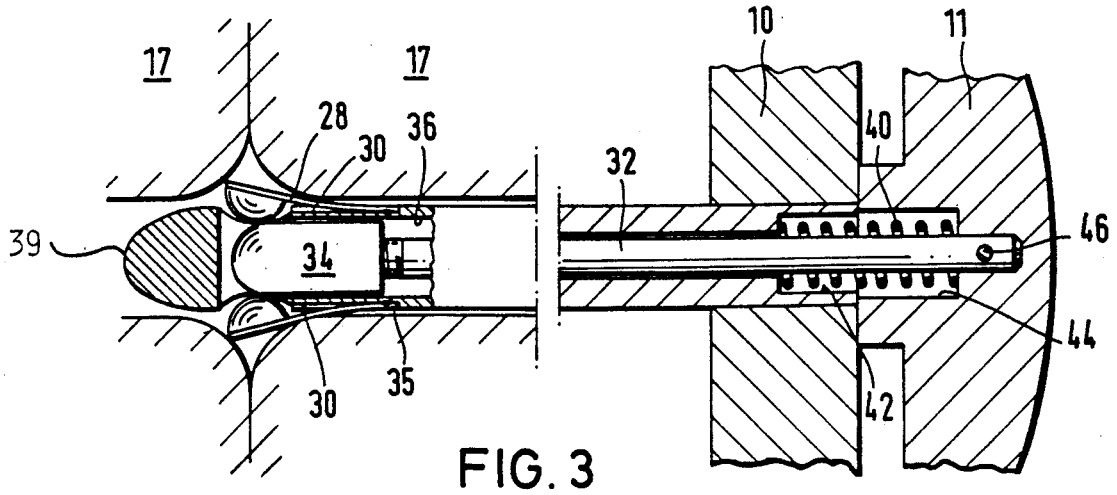
FIG. 3 is an enlarged sectional view of the removal tool showing at least one axially clamped in propelling charge module.

In order for the charge module or modules 17 to be easily released from the holding rod 12 during the gun loading process, the actuating plunger 32 may be automatically moved back into its starting position, with the clamping of the leaf springs 28 being simultaneously released. For this purpose, a compression spring 40 is provided and arranged around the actuating plunger 32 and within an axially extending exterior bore 42 of the holding handle 10 and holding rod 12, and a facing bore 44 of the actuating handle 11. The spring 40 is supported at the end surfaces of the bores 42 and 44 so that it is compressed when the tool 13 is actuated as shown in FIG. 3.

It will be understood that the above description of the present invention is susceptible to various modifications, changes, and adaptations, and the same are intended to be comprehended within the meaning and range of equivalents of the appended claims.

What is claimed is:

1. A tool for manual removal of propelling charge modules of the type having a hollow ignition channel from a magazine in which the modules are stored one behind the other with the channels aligned, said tool comprising:

a holding rod of a length and diameter permitting insertion of said holding rod into the hollow ignition channel of a desired number of said charge modules;

a radially oriented depth abutment mounted on said holding rod for axial displacement along said holding rod;

means for fastening said depth abutment at a desired location along said holding rod;

a holding handle fastened to one end of said holding rod; and a manually actuated clamping means, mounted in said holding rod, for arresting said charge modules disposed around said holding rod to prevent axial movement relative to said depth abutment; and wherein said clamping means comprises: an actuating plunger disposed in a longitudinal bore of said holding rod for axial movement and fastened, via a fastening means, to an actuating handle at an end which projects from said holding handle, with said actuating plunger including a rod portion and a cap disposed at an end of said rod portion of said actuating plunger opposite to said actuating handle, and with said cap being rounded at its front end and being of a larger diameter than said rod portion of said actuating plunger; and, means, responsive to axial displacement of said actuating plunger and engagement with said front end of said cap, for gripping an exterior surface of a charge module to cause said arresting.

2. A tool as defined in claim 1, wherein said means for gripping includes: at least one pair of diametrally opposed leaf springs, each extending substantially parallel to said longitudinal bore and having a rear end fastened to said holding rod; and a respective cam mounted on an interior surface of each said leaf spring at a front end thereof and opposite one another, with said cams normally extending in front of said front end of said cap and in a path of axial displacement of said actuating plunger.

3. A tool as defined in claim 2, wherein said leaf springs are disposed in longitudinally extending recesses formed in an outer surface of said holding rod and said cams, when not actuated by said plunger, project into a transverse bore in said holding rod.

4. A tool as defined in claim 3, wherein said cams have a hemispherical shape.

5. A tool as defined in claim 3, wherein the front outer end of said holding rod has an ogival shape.

6. A tool as defined in claim 2, wherein said holding rod is composed of two assemblable portions including a front rod attachment portion accommodating said leaf springs, and a rear rod portion which is releasably connected with said front rod attachment portion via a thread.

7. A tool as defined in claim 6, wherein the front outer end of said front rod attachment portion has an ogival shape.

8. A tool as defined in claim 2, further comprising spring means for normally urging said actuating plunger into a position wherein said plunger does not engage said cams.

9. A tool as defined in claim 8, wherein said spring means comprises a compression spring arranged around said actuating plunger between said holding handle and said actuating handle.

10. A tool as defined in claim 9, wherein said compression spring is disposed in a bore formed in an end surface of said holding handle and a corresponding aligned bore formed in an end surface of said actuating handle.

11. A tool as defined in claim 2, wherein the exterior surface of said holding rod is provided with a plurality of markers, spaced apart from each other by a distance corresponding to the length of a charge module, for setting the position of said depth abutment.

12. A tool as defined in claim 11, wherein said exterior surface of said holding rod is further provided with a plurality of circumferential grooves, which are spaced from each other by a distance corresponding to the length of a charge module, for engagement with said means for fastening said depth abutment.

* * * * *